United States Patent [19]

Hurst

[11] 3,987,142

[45] Oct. 19, 1976

[54] METHOD OF MOLDING BABY SOOTHER

[75] Inventor: Eric Kenneth Hurst, London, England

[73] Assignee: Lewis Woolf Griptight Limited, Birmingham, England

[22] Filed: Sept. 27, 1974

[21] Appl. No.: 510,051

Related U.S. Application Data

[62] Division of Ser. No. 432,557, Jan. 11, 1974, abandoned.

[30] Foreign Application Priority Data

Jan. 13, 1973 United Kingdom ..... 1892/73

[52] U.S. Cl. ..... 264/250; 264/274; 264/275; 264/301

[51] Int. Cl.[2] ..... B28B 1/38

[58] Field of Search ..... 264/250, 262, 274, 275, 264/306, 301

[56] References Cited

UNITED STATES PATENTS

| | | | |
|---|---|---|---|
| 1,372,004 | 3/1921 | Borchers | 128/360 |
| 2,017,604 | 10/1935 | Mountford et al. | 264/275 |
| 2,825,335 | 3/1958 | Natonek | 128/360 |
| 3,438,839 | 4/1969 | Williams et al. | 264/275 |
| 3,663,751 | 5/1972 | Oberg et al. | 264/262 |
| 3,730,959 | 5/1973 | Horres, Jr. et al. | 264/271 |

FOREIGN PATENTS OR APPLICATIONS

| | | | |
|---|---|---|---|
| 549,227 | 11/1942 | United Kingdom | 128/359 |

*Primary Examiner*—Robert F. White
*Assistant Examiner*—T. E. Balhoff

[57] ABSTRACT

A flexible baby soother comprising a tubular component defining a teat and a handle portion and a flange forming a shield moulded to the tubular component at the junction between the teat and handle portion.

2 Claims, 4 Drawing Figures

METHOD OF MOLDING BABY SOOTHER

This is a division of application Ser. No. 432,557 filed Jan. 11, 1974, now abandoned.

This invention relates to baby soothers the elements of which are a teat, a handle extending in a direction away from the teat and, between the handle and the teat, a flange forming a shield.

It is the principal object of the invention to provide a baby soother in which risk of separation of the elements of which it is composed, is substantially eliminated.

According to the present invention a flexible baby soother comprises a tubular component defining at one end a teat and at the other end a handle portion, the tubular component having secured onto it, between its ends, a flange forming the shield.

According to the further aspect of the invention, a method of forming a flexible baby soother comprises moulding a tubular combined teat and handle component, placing this in a mould and pouring material into the mould to form a flange at the junction of the teat and handle portions and secured to said tubular component.

Figure 1:
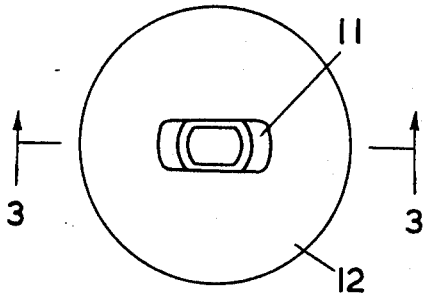
Figure 2:
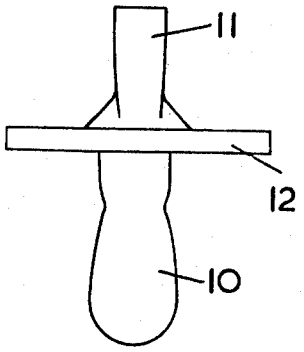
Figure 3:
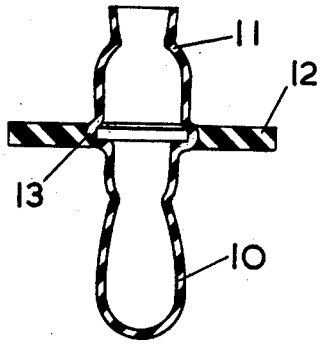
Figure 4:
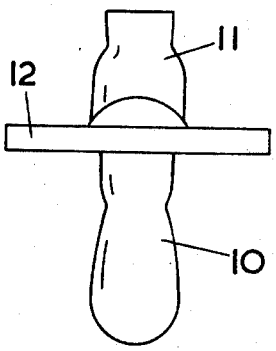

The invention will now be described by way of example with reference to the accompanying drawings in which FIG. 1 is a plan view of a baby soother constructed in accordance with the invention, FIG. 2 is a side elevation view, FIG. 3 is a cross-sectional view on the line 3—3 in FIG. 1, and FIG. 4 is another side elevation view.

The soother illustrated is made of a flexible material such as rubber and is constructed from two components which are permanently secured together. The major component of the soother is a tubular component defining, at one end, a teat 10 and at the other end a hollow handle portion 11. This single tubular component has, on the external surface of the mid-region thereof, a permanently connected flange 12.

The teat is of hollow olive or pear formation or other conventinal teat form.

The handle 11 is a flattened tube with a narrow neck opening near its end remote from the teat 10. Into this opening can engage a closure member (not illustrated). In the example shown the overall width of the handle is approximately equal to the maximum diameter of the teat 10. The flange 12 is flat and has a circular periphery. It is secured to the combined teat and handle component not only by a chemical bond but also by mechanical locking onto a convex bead 13 formed in the external surface of the teat and handle component.

In this example, the teat and handle portions are moulded by the latex dip process. In order to form and attach the flange 12, the preformed combined teat and handle component is inserted into the centre hole in a mould having a shallow tray with a circular periphery.

The component is inserted so that the bead 13 locates in the base of the tray in the interior thereof. The tray is now filled with further latex material which flows around and bonds to the bead portion of the teat and handle component as well as forming the disc shaped shield. After cooling, the complete device can be removed from the mould.

The teat portion can be filled, for example with a jelly material and this may be the same or a different colour from the material of the teat itself. Other fillings of the teat can be used. Furthermore, the handle portion may contain one or more coloured or other decorative inserts rendering its rigis or pliable as required. A small hollow capsule may be fitted in the handle, containing beads or other objects to make a rattle type soother.

The flange 12 may, moreover, incorporate coloured or other decorative inserts which may be rigid or pliable. In one example, a rigid insert in the form of a ring is used. This ring is loaded into the mould before pouring of the latex material to form the flange 12. During pouring, the insert becomes completely or partly encapsulated in the latex material. This arrangement provides some rigidity to the shield portion of this baby soother.

In an alternative construction, the flange is preformed from a rigid material. This has a centre hole in which the combined teat and handle component is located. To retain these parts together, additional latex material is poured around the joint after assembly. This additional material bonds with both the parts and also forms a mechanical locking arrangement to prevent subsequent separation of the parts.

I claim:

1. A method of forming a flexible baby soother comprising simultaneously forming by a single latex dip process a tubular component having integrally connected teat and handle portions and having a circumferential bead therebetween, placing the tubular component in a mould having a lateral tray surround the bead with the bead located in the tray and pouring latex material into the mould to provide an integral lateral flange on the tubular component, the flange being chemically bonded to and mechanically secured to the bead of the tubular component.

2. A method of forming a flexible baby soother comprising forming by a latex dip process a tubular component having integrally connected teat and handle portions and having a circumferential bead therebetween, placing said tubular component in a mould having a lateral tray surrounding the bead with the bead located in said tray, positioning a decorative insert in said lateral tray and pouring latex material into the tray and around the insert to provide an integral lateral flange on the tubular component, the flange being chemically bonded to and mechanically secured to the bead of the tubular component and said insert forming a decorative portion of the flange.

* * * * *